US005529411A

United States Patent [19]

Nakata

[11] Patent Number: 5,529,411

[45] Date of Patent: Jun. 25, 1996

[54] CARRIAGE DRIVING DEVICE IN PRINTING APPARATUS

[75] Inventor: Takashi Nakata, Aichi-gun, Japan

[73] Assignee: Brother Kogyo Kabushiki Kaisha, Nagoya, Japan

[21] Appl. No.: 352,596

[22] Filed: Dec. 9, 1994

[30] Foreign Application Priority Data

Dec. 13, 1993 [JP] Japan ..... 5-311665

[51] Int. Cl.[6] ..... B41J 19/30

[52] U.S. Cl. ..... 400/322; 400/335; 400/320

[58] Field of Search ..... 400/335, 336, 400/320, 322, 323

[56] References Cited

U.S. PATENT DOCUMENTS

| | | | |
|---|---|---|---|
| 4,427,314 | 1/1984 | Fujiwara et al. | 400/336 X |
| 4,526,486 | 7/1985 | Kikucai et al. | 400/320 X |
| 4,576,490 | 3/1986 | Isobe | 400/320 X |
| 4,687,361 | 8/1987 | Kikuchi et al. | 400/322 |
| 4,976,556 | 12/1990 | Longrod | 400/320 |

FOREIGN PATENT DOCUMENTS 62-42794 9/1987 Japan .

*Primary Examiner*—Christopher A. Bennett
*Attorney, Agent, or Firm*—Kane, Dalsimer, Sullivan, Kurucz, Levy, Eisele and Richard

[57] ABSTRACT

Disclosed is a carriage driving device in which a rack 8 with high rigidity and gear teeth 8*a* at one side elongated therethrough is fixed on a bottom frame 7*c* in a frame 7 of a printer 1 so that the rack 8 is arranged parallel with a platen 5, and both a pinion 16 meshed with the gear teeth 8*a* of the rack 8 and a driving motor 15 for rotating the pinion 16 are arranged on a plate 18 which is rotatably supported around a support shaft 17 in a horizontal direction on the carriage 2. The pinion 16 is biased by a spring 22 so as to constantly mesh with the gear teeth 8*a* of the rack 8. In the carriage 2, a first contact member 10 slidably contacting on the upper surface of the rack 8 and a second contact member 11 slidably contacting to the side of the rack 8 opposite to the side where the gear teeth 8*a* are formed, are arranged so that a predetermined positional relationship of the carriage 2 against the platen 5 is maintained.

Thereby, the rack 8 concludes to have two functions for guiding the carriage 2 reciprocally along the platen 5 and for maintaining the predetermined positional relationship between the carriage 2 and the platen 5, in addition to a function for driving the carriage 2 in cooperation with the driving motor 15.

12 Claims, 4 Drawing Sheets

CARRIAGE DRIVING DEVICE IN PRINTING APPARATUS

BACKGROUND OF THE INVENTION

1. Field of the Invention

The present invention relates to a carriage driving device for moving a carriage along a platen surface arranged in a printing apparatus such as a typewriter, a printer.

2. Description of Related Art

Conventionally, there are proposed various driving devices each of which is utilized for moving a carriage in a printing apparatus such as a typewriter or a printer. For instance, it is disclosed a carriage driving device in Japanese Patent Application, laid open No. Sho. 62-42,794 after substantive examination. In the carriage driving device, a main round guide bar having a rack at a side thereof is arranged along a platen, and both a pinion meshed with the rack and a driving motor for rotating the pinion are firmly mounted on a carriage. Further, a sub-guide bar is arranged parallel with the main guide bar so as to maintain a predetermined positional relationship of the carriage against the platen and the sub-guide bar is supported in an open recess formed in a rear part of the carriage so that the carriage can slidably move along the platen through cooperation of the sub-guide bar and the open recess.

However, according to the conventional carriage driving device mentioned above, unless the sub-guide bar is precisely arranged parallel with the main guide bar, it cannot be stably retained a positional relationship of the carriage against the platen, thereby the carriage cannot be stably moved while maintaining the predetermined positional relation with the platen. Further, in the conventional carriage driving device, the driving motor with the pinion is firmly mounted on the carriage. Therefore, in case that there exists an error in a distance with which the pinion is positioned against the main guide bar, various problems occur. For instance, if the distance between the main guide bar and the pinion is too wide, backlash occurring when the pinion meshes with the rack becomes too large. As a result, when the moving direction of the carriage is changed from the forward direction to the reverse direction, there occurs errors ill carriage movement. For example, there occurs a movement error of the carriage when the moving direction of the carriage is changed form the right direction to the left direction. And there occurs a timing error of the carriage movement. Thus, there is a problem that print quality of characters printed by the printing apparatus is deteriorated due to that pitches between the printed characters become irregular.

On the contrary, if the distance between the main guide bar and the pinion is too narrow, meshing load between the rack and the pinion becomes too large, thereby the driving motor is overloaded due to the meshing load occurring between the rack and the pinion. As a result, the carriage cannot be smoothly moved.

SUMMARY OF THE INVENTION

Accordingly, it is an object of the present invention to overcome the above mentioned problems and to provide a carriage driving device in a printing apparatus, through which not only a carriage can be easily mounted in the device but also backlash between a rack and a pinion can be removed, thereby the carriage can be smoothly moved.

To accomplish the object, the present invention provides a carriage driving device utilized in a printing apparatus including a frame with a pair of side frames and a bottom frame, a platen arranged between the side frames and a carriage mounting a print device thereon, the carriage being reciprocally moved along the platen, the carriage driving device comprising:

- a rack with high rigidity at one side of which gear teeth are formed, the rack being fixed on the frame;
- a plate arranged in the carriage, the plate being relatively rotatable with the carriage;
- a pinion meshed with the gear teeth;
- a driving motor for rotating the pinion, the driving motor being mounted on the plate;
- a bias means for biasing the plate in a direction that the pinion is constantly meshed with the gear teeth; and
- a contact means formed in the carriage, the contact means slidably contacting with two contact portions of the rack, one of which is positioned normally to the other, thereby the carriage is maintained with a predetermined positional relationship against the platen while the carriage is reciprocally moved along the platen.

According to the present invention, when printing of characters is conducted, the driving motor rotates the pinion. Thereby the carriage is reciprocally moved along the platen through cooperation of the rotated pinion and the gear teeth meshed with the pinion. At that time, since the contact means is formed ill the carriage and the contact means slidably contacts with two contact portions, one of which is positioned normally to the other, the carriage is maintained with the predetermined relationship against the platen while the carriage is reciprocally moved along the platen.

Therefore, the rack can conduct at the same time not only a function for guiding the carriage along the platen but also a function for maintaining the predetermined positional relationship of the carriage against the platen, in addition to a function for driving the carriage in cooperation with the driving motor. Accordingly, it is not necessary to arrange the main guide bar, the sub-guide bar and the rack each of which is elongated so that there exists a parallel relationship among them, as in the conventional carriage driving device. As a result, not only construction of the carriage driving device can be easily simplified but also producing cost thereof can be reduced.

Further, in the present invention, since the plate supporting the pinion thereon is biased in the direction so that the pinion is constantly meshed with the gear teeth, backlash occurring between the pinion and the gear teeth can be removed. Therefore, when moving direction of the carriage is changed from the forward direction to the reverse direction, a movement error and a timing error of the carriage never occur, thereby characters can be printed with high quality.

The above and further objects and novel features of the invention will more fully appear from the following detailed description when the same is read in connection with the accompanying drawings. It is to be expressly understood, however, that the drawings are for purpose of illustration only and not intended as a definition of the limits of the invention.

BRIEF DESCRIPTION OF THE DRAWINGS

The invention will be described with reference to the accompanying drawings, wherein.

DETAILED DESCRIPTION OF THE PREFERRED EMBODIMENTS

Figure 1:
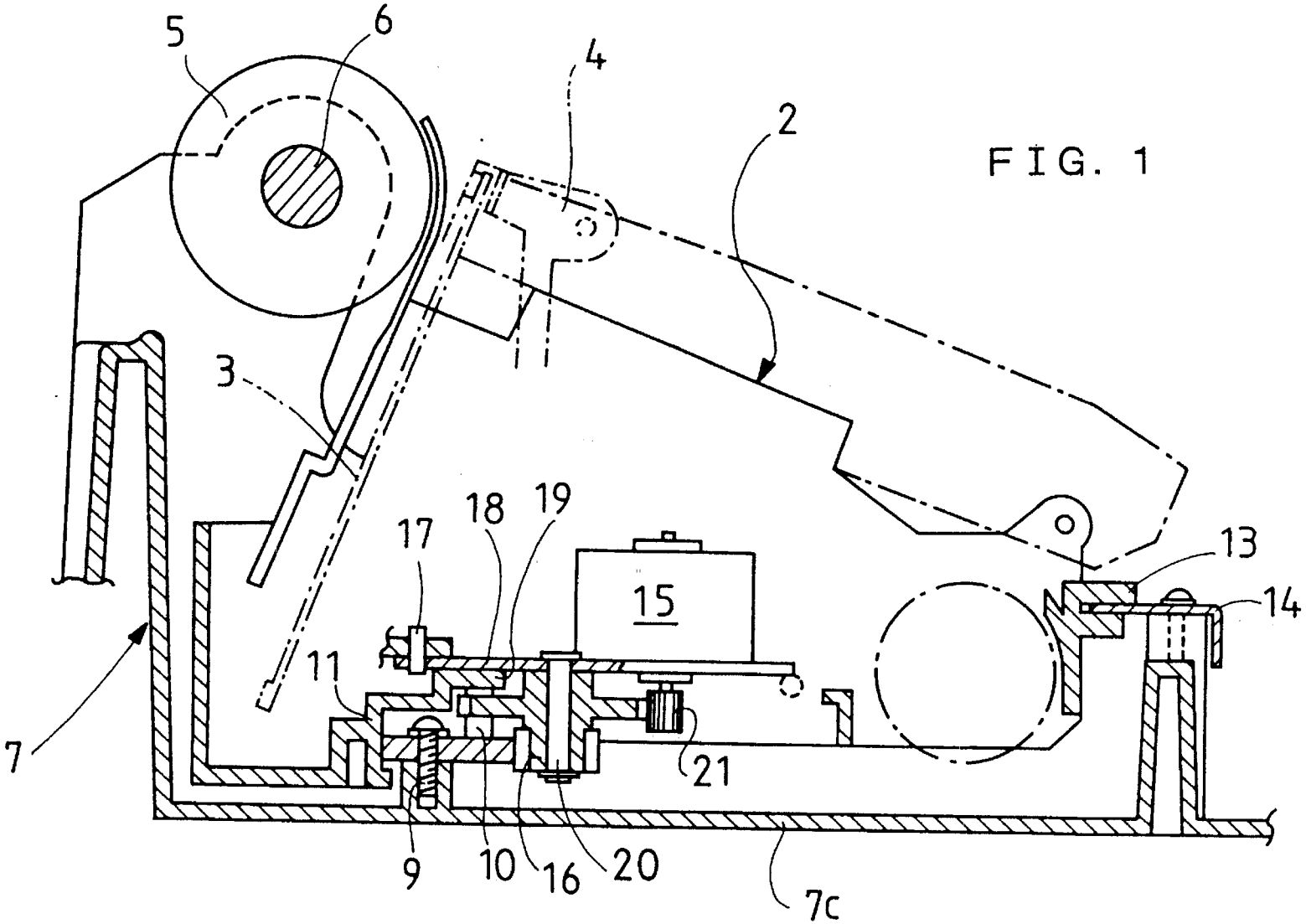
FIG. 1 is a schematic sectional view of a printing apparatus according to the embodiment.

A detailed description of the preferred embodiment will now be given referring to the accompanying drawings. In a printing apparatus 1 (printer) shown in FIG. 1, a carriage 2 is arranged in the printer i so as to be reciprocally movable to both the right and left directions along a printing surface of a roller platen 5. In the carriage 2, a daisy wheel 3 in which a plurality of spokes are extended from a central portion thereof and a character portion is formed on each top of the spokes, a hammer 4 for striking a rear face of the character portion toward the printing surface of the platen 5 and a printing mechanism having a driving means (not shown in detail), are mounted on the carriage 2. Here, construction of the daisy wheel 3, the hammer 4 and the printing mechanism is well-known, thus detailed description thereof will be omitted.

A shaft 6 of the platen 5 is rotatably supported between the right and the left side frames 7*a*, 7*b* (see FIG. 2) in a frame 7, the frame 7 being formed of synthetic resin. And a platen knob 40 is fixed to one end (the left end in FIG. 2) of the shaft 6 so as to rotate with the shaft 6. At the inner surface (the right surface in FIG. 2) of the platen knob 40, a gear 41 is formed into one body with the platen knob 40 and the gear 41 is rotated through a slowdown gear mechanism 43 by a platen motor 42 for rotating the platen 5.

A rack 8 is fixed onto a bottom frame 7*c* of the frame 7 by a plurality of bolts 9 screwed in the bottom frame 7*c* so that the rack 8 is arranged parallel with the platen 5. The carriage 2 is reciprocally moved along the rack 8.

Here, the rack 8 is formed of material having high rigidity such as steel or resin and the rack 8 is figured so as to have a square section. Further, gear teeth 8*a* are formed at one side of the rack 8 along an elongated direction thereof, the one side being selected among both sides so that it is more distant from the platen 5.

Figure 5:
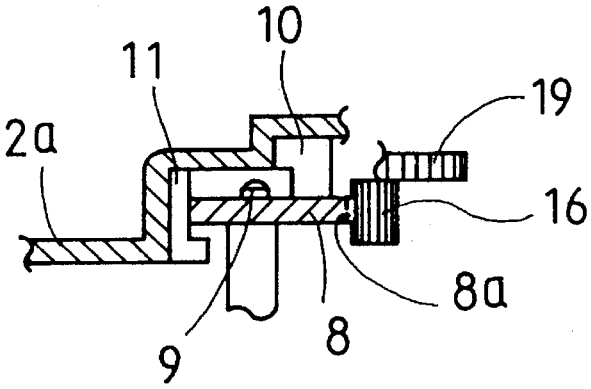
FIG. 5 is a B—B sectional view in FIG. 4.

On a lower surface of a bottom plate 2*a* in the carriage 2, a first contact member 10 which is slid along the upper surface of the rack 8 while contacting thereon and a second contact member 11 which is slid along the opposite side of the rack 8 to the side where the gear teeth 8*a* are formed while contacting therewith, are formed. See FIGS. 1 and 5. According to this construction, it can maintain a predetermined positional relationship of the carriage 2 against the printing surface of the platen 5.

At the rear part of the carriage 2 as shown in FIG. 1, a slider 13 which is bifurcated in up and down directions is formed. The slider 13 is slidably disposed on a receiving rail 14 which is formed so as to have a section in a L-shaped figure and fixed at the rear part of the frame 7 by screws, thereby it can prevent the carriage 2 from being rotated upward.

Figure 2:
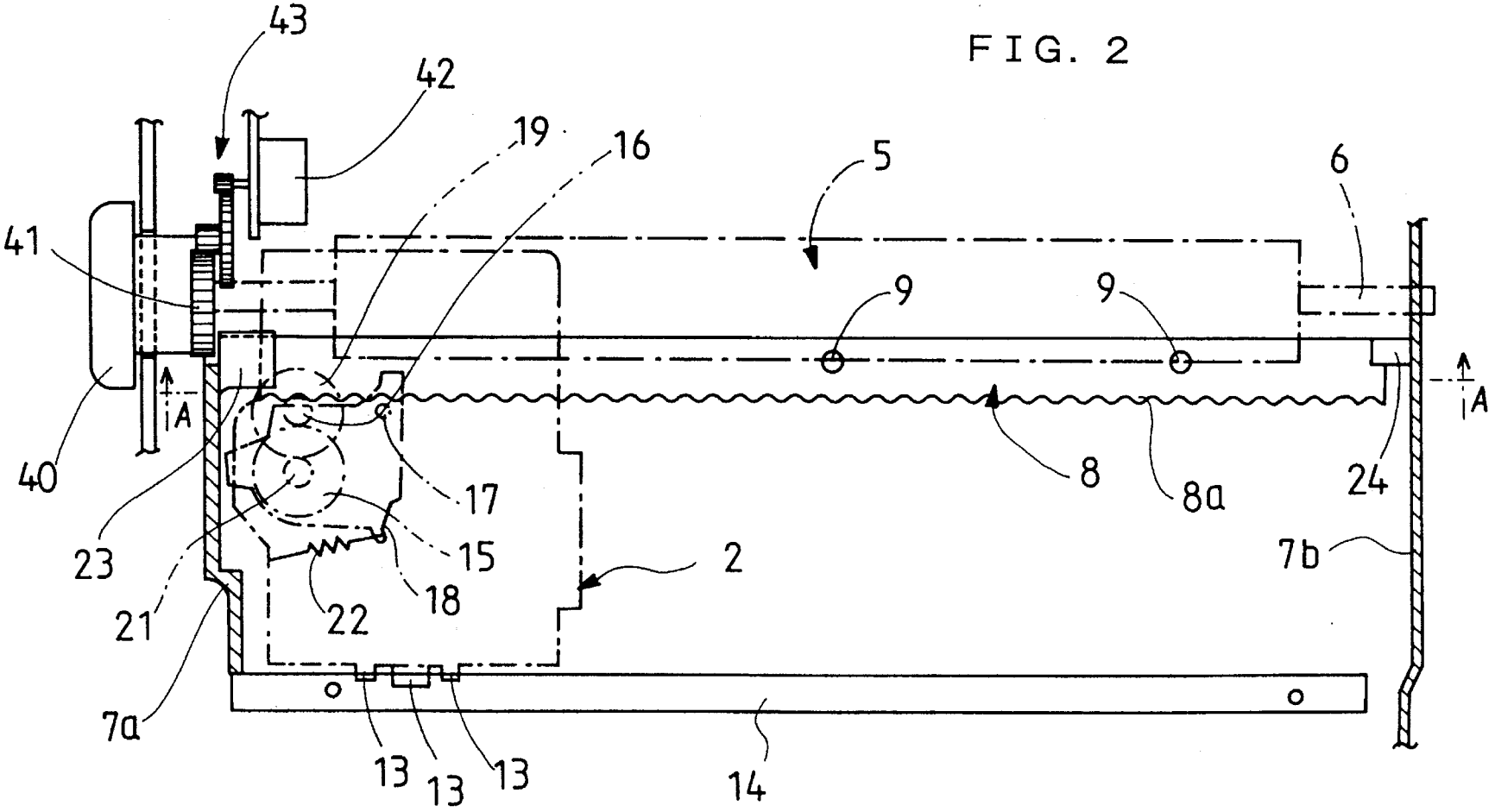
FIG. 2 is a plan view showing a positional relationship between a carriage and a rack in the printing apparatus.
Figure 3:
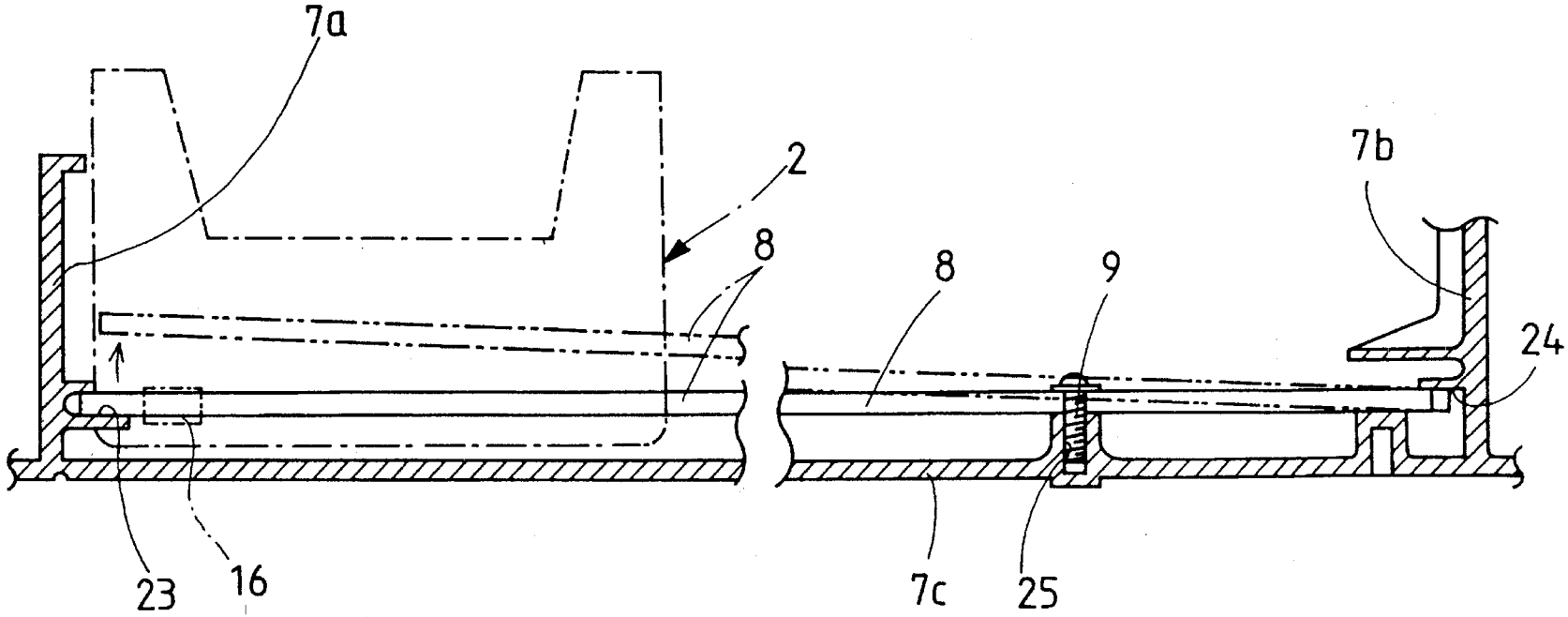
FIG. 3 is an enlarged A—A sectional view in FIG. 2.
Figure 4:
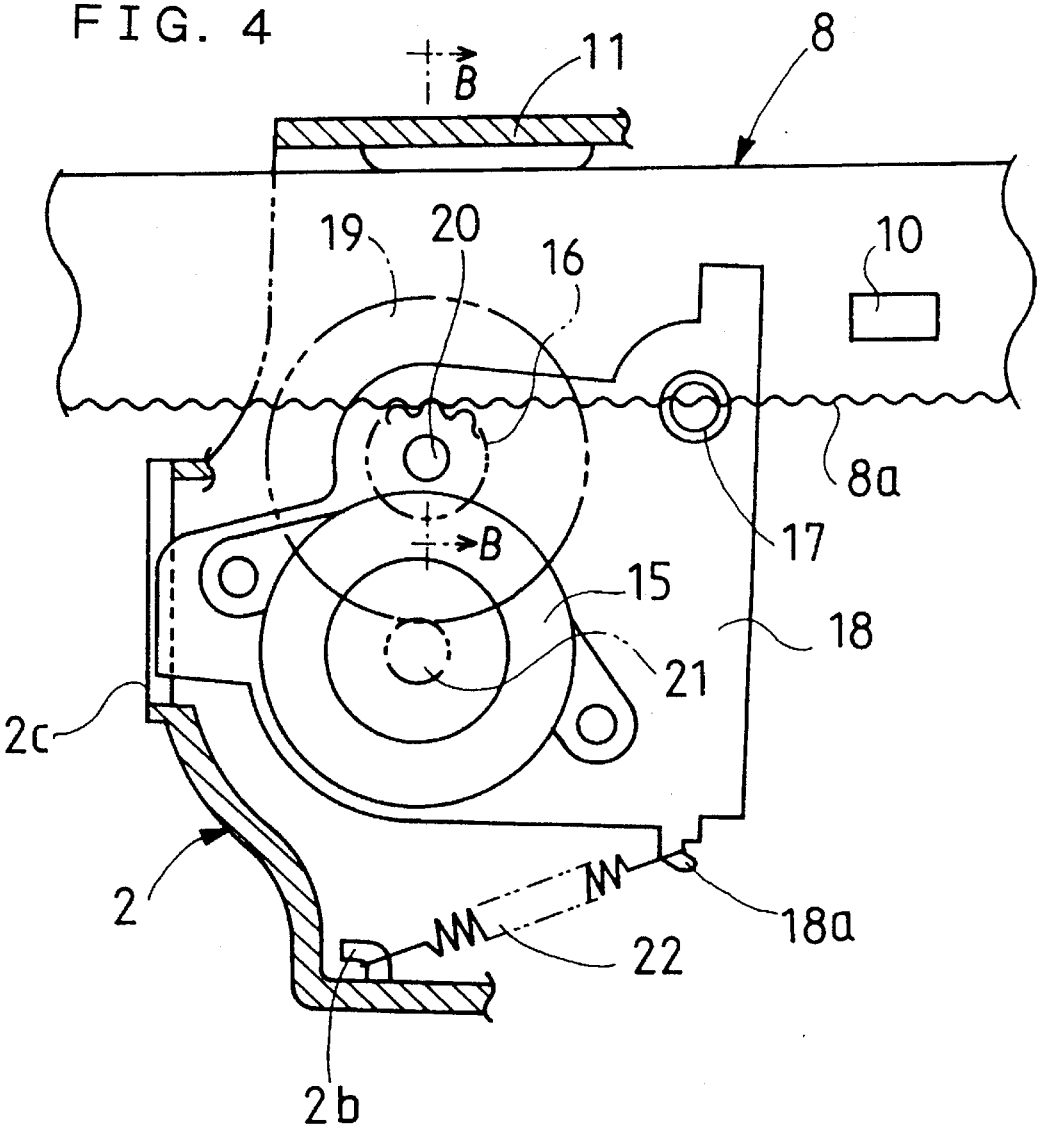
FIG. 4 is an enlarged sectional view of a main part in FIG. 2.

A plate 18 is supported on the carriage 2 so as to be horizontally rotatable around a support shaft 17. On the plate 18, a pinion 18 meshed with the gear teeth 8*a* of the rack 8 and a driving motor 15 for rotating the pinion 16 are arranged. That is to say, as shown in FIG. 1, the pinion 16 and an intervening gear 19 are formed into one gear body, the gear body being rotatably supported on the lower surface of the plate 18 by a support shaft 20. Further, a driving gear 21 connected to a driving shaft of the driving motor 15 fixed on the upper surface of the plate 18, is arranged so as to mesh with the intervening gear 19 through a hole formed in the plate 18. And the plate 18 is biased in clockwise direction as shown in FIGS. 2, 4 by a spring 22 so that the pinion 16 is constantly meshed with the gear teeth 8*a* of the rack 8. The spring 22 is engaged between an engaging portion 18*a* formed at a side of the plate 18 and an engaging portion 2*b* formed on an inner side of the carriage 2. The plate 18 is slidably supported on a slide portion 2*c* formed on the carriage 2 so that the plate 18 is not gone down at a free end portion thereof. Here, two or more of the slide portions 2*c* may be formed if necessary. And both ends of the rack 8 are, as shown in FIG. 3, inserted and engaged in engaging recesses 23, 24 which are formed in the right and the left side frames 7*a*, 7*b*, respectively. Further, the main portion of the rack 8 between the both ends is fixed to the bottom frame 7*c* by screwing the screw 9 in a screw hole 25 formed on the bottom frame 7*c*.

According to the above construction, in comparison with the conventional carriage driving device, the rack 8 is not deformed based on the high rigidity thereof and the predetermined positional relationship of the carriage 2 against the platen 5 can be maintained through cooperation of the first and the second contact members 10, 11, both contact members 10, 11 contacting with the upper surface and the opposite side of the rack 8 to the side where the gear teeth 8*a* are formed. At this point, the portion of the carriage 2 with which the first contact member 10 contacts is positioned normally to the portion with which the second contact member 11 contacts. In addition to the above, the carriage 2 can be reciprocally moved along the rack 8 through cooperation of the first and the second contact members 10, 11 because both the contact members 10, 11 are slidably contacted with the upper surface and the opposite side of the rack 8 while the carriage 2 is moved.

Therefore, the rack 8 can act as not only the main guide bar in the conventional device when the carriage 2 is reciprocally moved along the platen 5, but also the sub-guide bar in the conventional device, the sub-guide bar being utilized for maintaining the predetermined positional relationship between the carriage and the platen. As a result, according to the embodiment, it can be omitted both the main guide bar and the sub-guide bar. Further, since the main guide bar does not exist in the carriage driving device of the embodiment, adjustment for precisely adjusting the rack 8 and the main guide bar so as to maintain parallel relationship between the rack 8 and the main guide bar is not necessary at all.

Further, the pinion 16 arranged on the rotatable plate 18 is constantly meshed with the gear teeth 8*a* of the rack 8 by being depressed through the spring 22. Thus, the backlash occurring between the pinion 16 and the gear teeth 8*a* can be removed. As a result, when moving direction of the carriage 2 is changed from the forward direction to the reverse direction, a movement error and a timing error of the carriage 2 never occur, thereby characters can be printed with high quality.

While the invention has been particularly shown and described with reference to preferred embodiments thereof, it will be understood by those skilled in the art that the foregoing and other changes in form and details can be made therein without departing from the spirit and scope of the invention.

For instance, though both the pinion 16 and the driving motor 15 are arranged on the plate 18, it may be conceivable that the pinion 16 is supported on a rotatable arm (not shown) and the arm is rotatably arranged on the plate 18 or the carriage 2.

And though the gear body, in which the pinion 16 and the intervening gear 19 are formed into one body, is rotatably supported on the lower surface of the plate 18 in the embodiment, such gear body including the pinion 16 and the intervening gear 19 may be directly connected to the driving shaft of the driving motor 15.

Further, the carriage driving device of the embodiment is adoptable for the printer which has a printing means such as an impact print head conducting printing by print wires, a thermal head conducting printing by heat elements, an ink jet head conducting printing by ejecting droplets of ink therefrom or a typewriter having a driving mechanism including a carriage.

What is claimed is:

1. A carriage driving device utilized in a printing apparatus including a frame with a pair of side frames and a bottom frame, a platen arranged between the side frames and a carriage mounting a print device thereon, the carriage being reciprocally moved along the platen, the carriage driving device comprising:

a rack with high rigidity at one side of which gear teeth are formed, the rack being fixed on the frame;

a plate arranged in the carriage, the plate being relatively rotatable with the carriage;

a pinion meshed with the gear teeth;

a driving motor for rotating the pinion, the driving motor being mounted on the plate;

a bias means for biasing the plate in a direction that the pinion is constantly meshed with the gear teeth; and a contact means formed in the carriage, the contact means slidably contacting with two contact portions of the rack, one of which is positioned normally to the other, thereby the carriage is maintained with a predetermined positional relationship against the platen while the carriage is reciprocally moved along the platen.

2. The carriage driving device according to claim 1, wherein the contact means comprises a first contact member which contacts on an upper surface of the rack and a second contact member which contacts at the other side of the rack opposite to the one side where the gear teeth is formed.

3. The carriage driving device according to claim 2, wherein the first and the second contact members are formed into one body with the carriage.

4. The carriage driving device according to claim 1, wherein the rack is formed of material having high rigidity, the material being selected from steel or resin.

5. The carriage driving device according to claim 1, wherein the one side at which the gear teeth is formed is more distant from the platen than the other side.

6. The carriage driving device according to claim 1, further comprising:

a rail fixed to a rear part of the frame; and a bifurcated slider member formed at a rear part of the carriage, the slider member being slidably disposed on the rail.

7. The carriage driving device according to claim 1, wherein the pinion is supported on a lower surface of the plate and the driving motor is mounted on an upper surface of the plate.

8. The carriage driving device according to claim 7, further comprising:

an intervening gear formed into one body with the pinion; and a driving gear connected to a driving shaft of the driving motor, the driving gear being meshed with the intervening gear;

wherein the pinion is rotated with the intervening gear through the driving gear being rotated by the driving motor.

9. The carriage driving device according to claim 1, wherein the bias means comprises a spring.

10. The carriage driving device according to claim 9, further comprising:

a first engaging portion formed in the plate; and a second engaging portion formed in the carriage;

wherein the spring is engaged between the first and the second engaging portions.

11. The carriage driving device according to claim 1, further comprising a slide portion on the carriage, the plate being slidably supported on the slide portion.

12. A carriage driving device utilized in a printing apparatus including a frame with a pair of side frames and a bottom frame, a platen arranged between the side frames and a carriage mounting a print device thereon, the carriage being reciprocally moved along the platen, the carriage driving device comprising:

a rack with high rigidity at one side of which gear teeth are formed, the rack being fixed on the bottom frame;

a plate arranged in the carriage, the plate being relatively rotatable with the carriage;

a pinion rotatably supported on the plate, the pinion being meshed with the gear teeth;

a driving motor for rotating the pinion, the driving motor being mounted on the plate;

a bias means for biasing the plate in a direction that the pinion is constantly meshed with the gear teeth; and a first contact member which contacts on an upper surface of the rack and a second contact member which contacts at the other side of the rack opposite to the one side where the gear teeth is formed, thereby the carriage is maintained with a predetermined positional relationship against the platen while the carriage is reciprocally moved along the platen.

* * * * *